US006311445B1

(12) United States Patent
Macander et al.

(10) Patent No.: US 6,311,445 B1
(45) Date of Patent: Nov. 6, 2001

(54) MODULAR LOUVER SYSTEM

(75) Inventors: Aleksander B. Macander, Rockville, MD (US); David W. Johnson, San Diego, CA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 09/533,179

(22) Filed: Mar. 22, 2000

(51) Int. Cl.[7] ..... E06B 7/08

(52) U.S. Cl. ..... 52/473; 52/656.8; 52/656.9; 52/780

(58) Field of Search ..... 52/473, 780, 781, 52/656.7, 656.8, 656.9

(56) References Cited

U.S. PATENT DOCUMENTS

| | | | | |
|---|---|---|---|---|
| 2,987,985 | | 6/1961 | Johnson . | |
| 3,068,536 | * | 12/1962 | Lieber | 52/473 |
| 3,217,631 | * | 11/1965 | Thompson et al. | 52/473 X |
| 3,394,518 | * | 7/1968 | Worrell, Jr. | 52/473 |
| 3,968,738 | | 7/1976 | Matzke . | |
| 3,991,533 | * | 11/1976 | Nagase | 52/473 |
| 4,498,660 | | 2/1985 | Brema et al. . | |
| 4,592,271 | | 6/1986 | Young . | |
| 4,688,767 | | 8/1987 | Bradshaw . | |
| 5,072,561 | | 12/1991 | Pitt . | |
| 5,163,260 | * | 11/1992 | Ricard et al. | 52/473 |
| 5,349,799 | | 9/1994 | Schiedegger et al. . | |
| 5,680,737 | * | 10/1997 | Sheipline | 52/656.9 X |
| 5,718,094 | * | 2/1998 | Meurer | 52/656.8 |
| 5,826,393 | | 10/1998 | Wenzlaff et al. . | |
| 5,839,244 | | 11/1998 | Johnson et al. . | |
| 6,076,321 | * | 6/2000 | Holland | 52/473 |

FOREIGN PATENT DOCUMENTS

| | | | | |
|---|---|---|---|---|
| 2253-908 | * | 7/1975 | (FR) | 52/473 |
| 2257-771 | * | 8/1975 | (FR) | 52/473 |

* cited by examiner

*Primary Examiner*—Beth A. Stephan
*Assistant Examiner*—Brian E. Glessner
(74) *Attorney, Agent, or Firm*—Steven Crabb

(57) ABSTRACT

A modular louver system is disclosed which utilizes a series of joined frames having the same basic cross section, a series of spacers, and a series of louver vanes having the same v shaped cross section. The frames have a t-shaped channel, with inwardly facing channel lips defining the narrow portion of the t-shaped channel. The louver vanes have a dovetail at each end, where the dovetail neck will fit in the area defined by the inwardly facing channel lips. In addition, the spacers are shaped so that they will rest in the t-shaped channel and will either separate the louver vanes from each other or from an adjacent frame. The louver vane dovetails are inserted in the t-shaped channels of opposing frames, with at least one spacer inserted in the t-shaped channels to separate the louver vanes from each other and from an adjacent frame. Where rectangular connection is desired, the frames are connected either using a clip joint arrangement. Where the modular louver system uses rounded corners, a corner frame is used to allow for a rounded edge.

19 Claims, 8 Drawing Sheets

MODULAR LOUVER SYSTEM

STATEMENT OF GOVERNMENT INTEREST

The invention described herein may be manufactured and used by or for the Government of the United States of America for governmental purposes without payment of any royalties thereon or therefore.

BACKGROUND OF THE INVENTION

1. Field of the Invention

This invention relates to a louver system for use in ventilating ships, buildings, and other confined spaces. Specifically, this invention relates to a modular louver system where the louver frame and the louver vanes are modular.

2. Description of the Related Art

In order to ventilate the interior space of a ship or a building, it is a common practice to install a louver over an opening to allow air to flow into and out of the confined space. By using a louver, the air is allowed to flow into the space while still providing a covering for the opening to prevent unwanted intrusion from outside elements. As such, louvers provide an economical means to vent a confined space and enjoy widespread use in the building industry, at industrial facilities, and for ventilating machinery spaces on ships.

Previous designs for louver systems required that louvers contain specially manufactured items. For instance, certain designs such as U.S. Pat. Nos. 5,349,799, and 4,592,271 require the use of previously-build solid frames and have the louver vanes built into these solid frames. This approach, while advantageous for covering numerous openings of uniform size, is cost prohibitive where the openings are of varied sizes.

Other designs attempted to overcome this shortcoming by creating more modular frames. Some, such as U.S. Pat. No. 5,826,393 use pre-sized sets of louver vanes that are connected prior to installation to make a large enough louver to cover a large opening. However, while this system eliminates the need for pre-built frames, since the louver vane sets are pre-made, this system is still only practicable where the sizes of the openings are essentially similar.

In order to create louver systems that are truly adaptable to multiple openings, more modular systems have been suggested. These systems rely upon modular frames, and mechanisms to lock individual louver vanes into these modular frames. Some systems, such as those suggested by U.S. Pat. No. 5,839,244 rely upon special notches made in the modular frames. These notches provide a resting place for individual louver vanes. Other solutions such as that suggested by U.S. Pat. No. 5,072,561 rely upon systems of bosses or projections on each modular frame. These bosses provide support for the louver vanes. However, these solutions require after-production tooling of the modular frames in order to create the notches or attach bosses. In addition, fitting louver vanes into these notches or bosses can be time consuming.

In order to create a bracketless modular louver, other designs such as U.S. Pat. No. 3,968,738 rely upon special retaining frames having flanges that fit into the modular frame members. These modular frame members have t-shaped channels, and the retaining frame flanges would slide into the t-shaped channels, thus using the t-shaped channel. The retaining frames have pre-cut notches that are designed to support individual louver frames. In this way, the retaining frame supports the louver vanes, and the retaining frame is supported by t-shaped channel of the modular frame. However, while this approach is entirely modular and requires little post-production work, inserting louver vanes into these notches takes a significant amount of time, which also makes them time-consuming to install.

In order to reduce the time needed to install louvers, other solutions have included stacking the louver vanes on top of one another, and separating them by spacers. For instance, in U.S. Pat. No. 4,688,767, the design is for a louvered wall where spacers separate the louver vanes. However, these spacers are not highly restrained against lateral movement, and instead rely largely upon gravity and adhesives to restrain the movement of the louver vanes.

An additional louver design, shown in U.S. Pat. No. 4,498,660, uses louver vanes with integral spacers to create a louver fence. These spacers also act as attachments to fence posts. However, this design does not provide for the use of either t-shaped channels in the fence posts to provide lateral support to the louver frames, or to use modular frames members outside of the fence posts at all in the construction of the louver fence. Since modular frames are generally preferred when installing louver systems into structures instead of using them as fences, this louver fence solution is impractical for non-fence uses.

Lastly, a further design is suggested by U.S. Pat. No. 2,987,985, which suggests the use of a modular frame in combination with spacers that support the louver vanes. The spacers are locked into t-shaped channels in the modular frames in order to reduce the lateral movement of the spacers. However, there is no direct way to prevent the louver vanes from moving laterally. As such, this system relies upon applying a compressive force upon the stacked louver vane and spacer assembly.

As such, there is no known modular louver vane system that is sufficiently modular to allow installation over multiple non-standard openings, and that provides direct lateral support to louver vanes through the use of modular frames.

SUMMARY OF THE INVENTION

Accordingly, it is the object of this invention to provide a modular louver and frame system that is quick and inexpensive to build, and simple to maintain.

It is a further object of this invention to provide a modular frame that directly restrains the lateral movement of the installed louver vanes.

It is a further object of this invention to provide a modular frame connected by joints that require little adhesives or other fasteners.

It is a still further object of this invention to provide a modular louver system comprising essentially identical parts, which can be adapted using rudimentary tools to cover any sized openings.

DESCRIPTION OF THE PREFERRED EMBODIMENT

Figure 1:
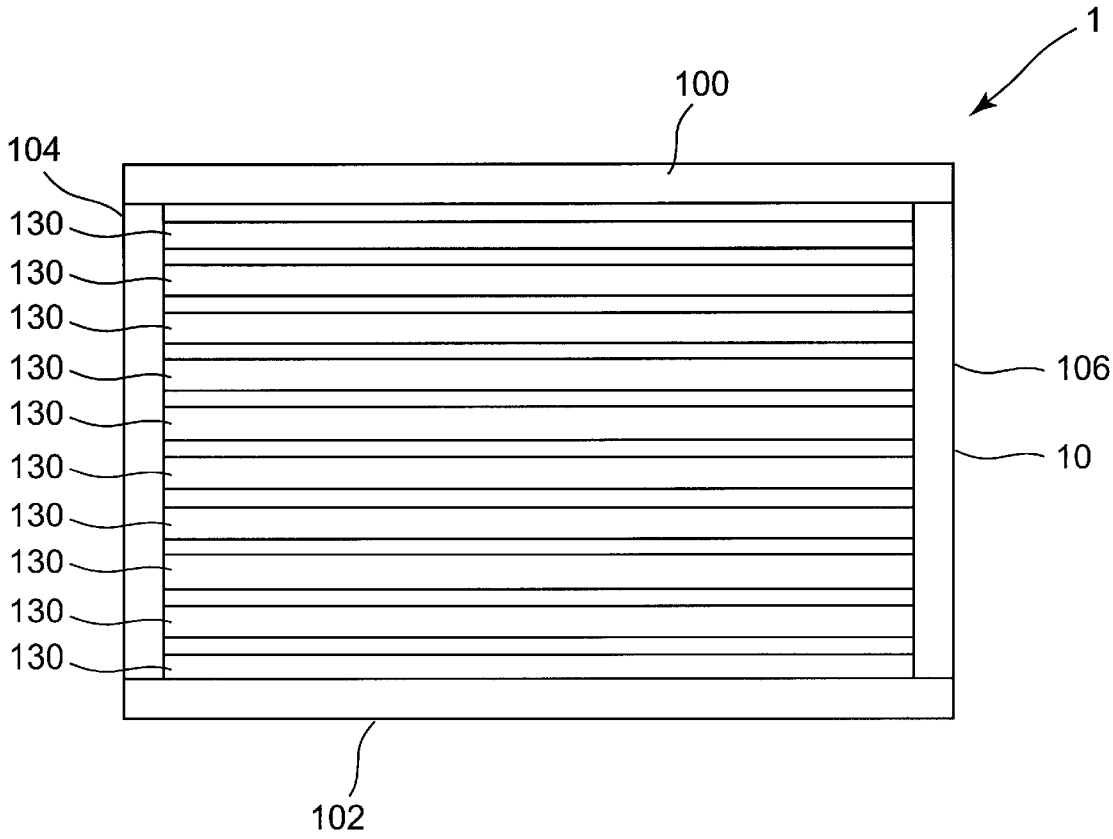
FIG. 1 is front view of the rectangular embodiment of the modular louver system showing the frames and louver vanes according to the present invention.

As shown in FIG. 1, the modular louver system 1 comprises a modular frame 10 that houses a set of louver vanes 130. The modular frame 10 consists of side frames 104 and 106, which are the support elements that laterally restrain the movement of the louver vanes 130. In addition, there is a top frame 100 and a bottom frame 102 which are connected to the side frames 104 and 106. The top frame 100 and the bottom frame 102 are non-support elements in that they do not directly restrain the lateral movement of the louver vanes 130. Instead, as shown in FIG. 1, these non-support elements, frames 100 and 102, connect and separate the support elements, frames 104 and 106.

Figure 2:
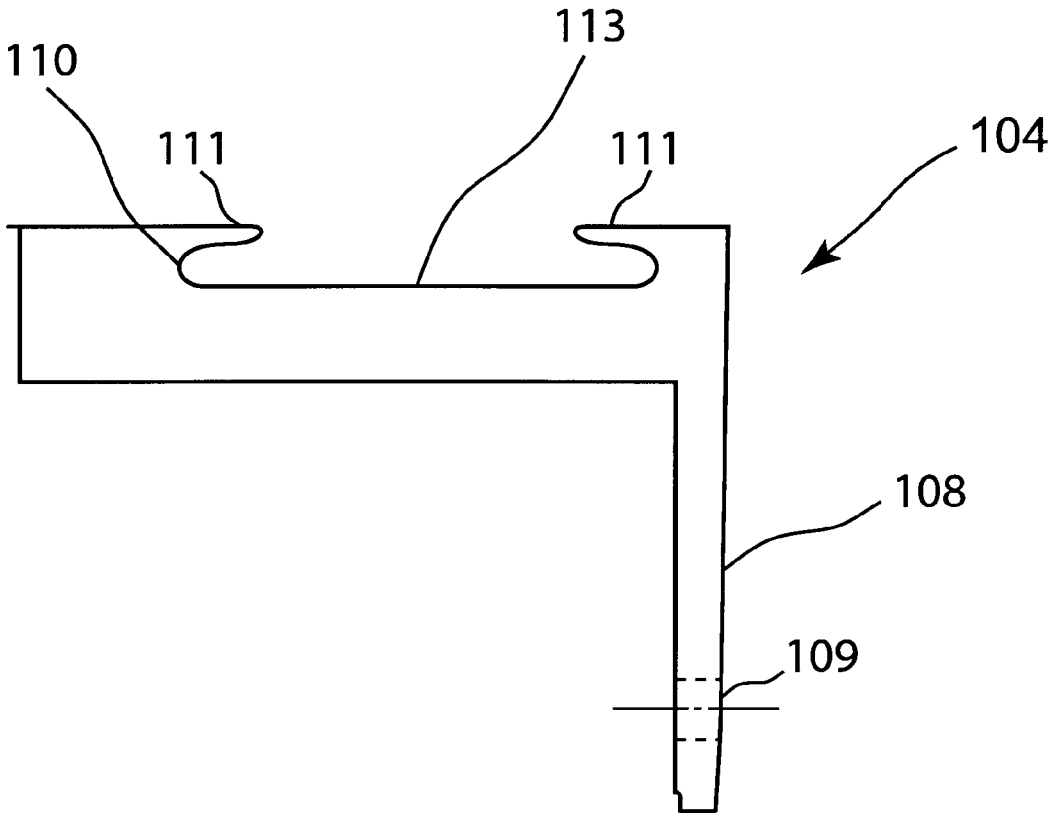
FIG. 2 is cross sectional view of a side frame showing the T-shaped channel according to the present invention.

Side frames 104 and 106, as well as top and bottom frames 100 and 102 have the same basic cross section. As shown in FIG. 2 for side frame 104, this cross section includes a t-shaped channel 110. The t-shaped channel 110 has a channel base 113 and a pair of opposing channel lips 111 that define a "T". In addition, there is a fastening flange 108, which allows the modular frame 10 to be attached to the outside walls of an opening using traditional fasteners, glue, or a combination thereof In the preferred embodiment, an outside mount is used and so flange holes 109 are created in the fastening flange 108. Of course, for other types of mounting, such as where the modular louver system 1 will be incorporated into an opening, this fastening flange 108 might not be used. In addition, while not shown, where the modular louver system 1 is mounted directly into a wall or similar thick structure, it is possible not to use some or all of frames 100, 102, 104, and 106, but instead to create a t-shaped channel 110 directly into the thickness of the wall.

Figure 3:
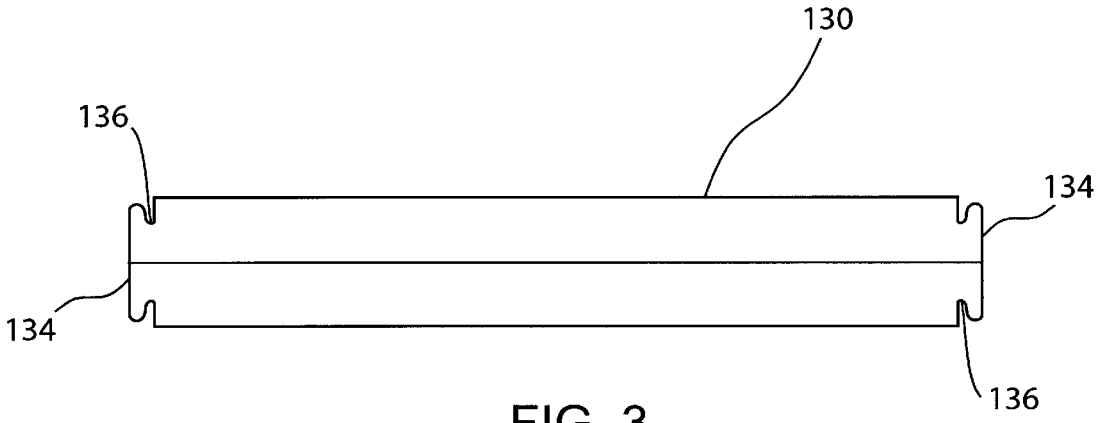
FIG. 3 is a top view of a louver vane showing the dovetails according to the present invention.

As shown in FIG. 3, the louver vanes 130 have a dovetail 134 at each end. The dovetail 134 has a neck 136 small enough to fit into the opening defined by the channel lips 111. For each louver vane 130, its dovetails 134 are inserted into the t-shaped channel 110 of the respective side frames 104 or 106, thereby trapping the dovetails 134 in the side frames 104 or 106 and allowing these frames to restrict the lateral movement of the louver 130. It is through this dovetail connection that the modular louver system 1 utilizes these t-shaped channels 110 to laterally restrain its louver vanes 130.

Figure 4:
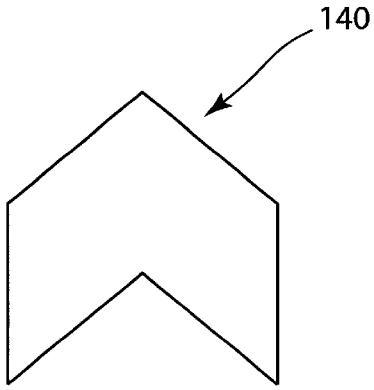
FIG. 4 is a front view of an intermediate spacer according to the present invention.
Figure 5:
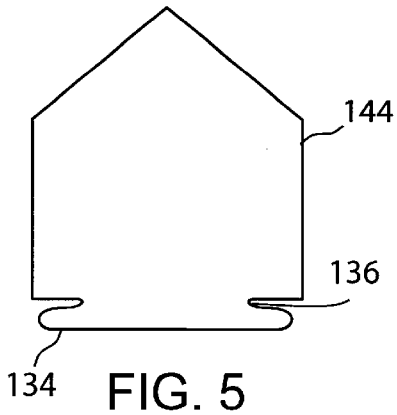
FIG. 5 is a front view of a bottom spacer according to the present invention.
Figure 6:
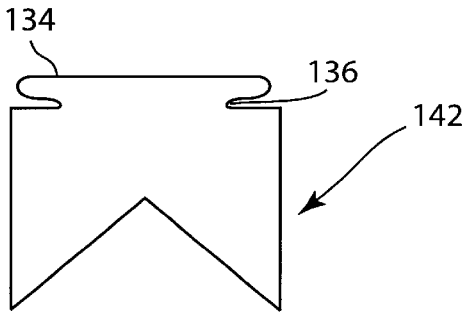
FIG. 6 is a front view of a top spacer according to the present invention.

In order to separate and support the louver vanes 130, the modular louver system 1 employs spacers 140, 142, & 144, which are shown in FIGS. 4, 5, and 6. FIG. 4 shows an intermediate spacer 140, which is used to separate and support adjacent louver vanes 130. The terminal spacers, a top spacer 142 and a bottom spacer 144, are shown in FIGS. 5 and 6, respectively, and are used to separate louver vanes 130 from their adjacent top frame 100 or bottom frame 102. When used in the preferred embodiment, the spacers 140, 142, and 144 are channel spacers, meaning that they are sufficiently thick and wide as to remain in the t-shaped channel 110.

As the louver vanes 130 have a "V" shaped cross-section, spacers 140, 142, and 144 all have corresponding "V" shapes to allow a clean mating between the spacers 140, 142, and 144 and the louver vanes 110. In addition, the top spacer 142 and bottom spacer 144 both have a dovetail 134 to allow them to fit into the t-shaped channels 110 in top and bottom frames 100 and 102. Obviously, where other shaped louver vanes 130 are used, the shape of the spacers 140, 142, and 144 will be altered to reflect this different shape.

Figure 7:
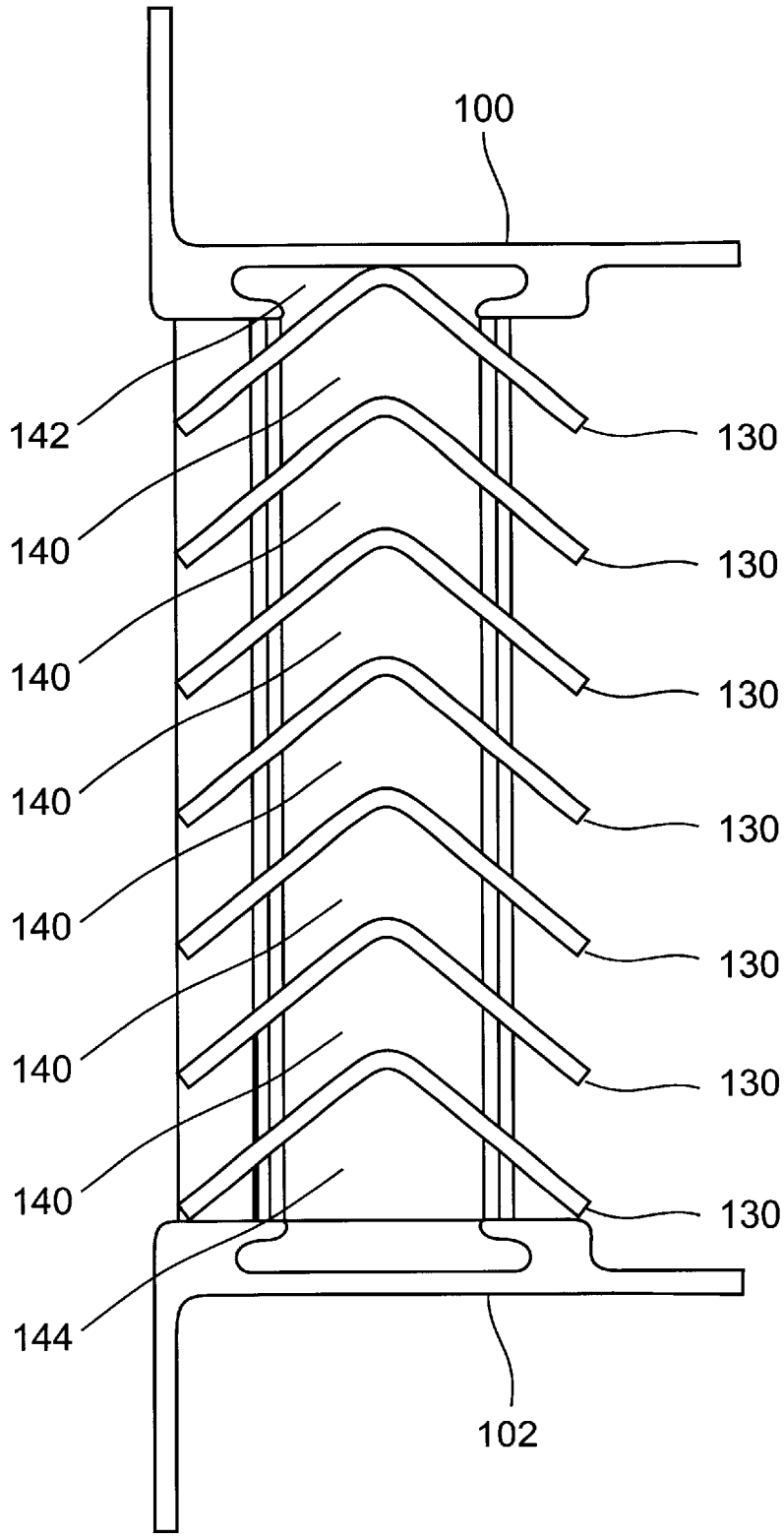
FIG. 7 is a side view of the modular louver system showing the stacking relationship between the louver vanes and the intermediate spacers, and the relationship between the top and bottom spacers, their adjacent louver vanes, and the top and bottom frames according to the present invention.

The preferred embodiment for using the spacers 140, 142, and 144 is shown in FIG. 7 for the side frame 106, with side frame 104 not shown. The top spacer 142 is in the t-shaped channel 110 and separates the top frame 100 from its adjacent louver vane 130. The intermediate spacers 140 are in the t-shaped channel 110 and separate the adjacent louver vanes 130. The bottom spacer 144 is in the t-shaped channel 110 and separates the bottom frame 102 from its adjacent louver vane 130.

In the preferred embodiment, the intermediate spacers 140 are of uniform size so as to maintain a consistent gap between the louver vanes 130. In addition, the preferred embodiment has that the top spacers 142 and bottom spacers 144 sufficiently large so as to dampen the rattling and general vibration of the louver vanes 130 and intermediate spacers 140. However, it is recognized that the intermediate spacers 140 do not need to be of identical size in all applications, and top and bottom spacers 142 and 144 are not needed in all applications. It is also recognized, but not shown, that the spacers 140, 142, or 144 need not always be in the t-shaped channels 110 so long as they support and separate the louver vanes 130.

Figure 8:
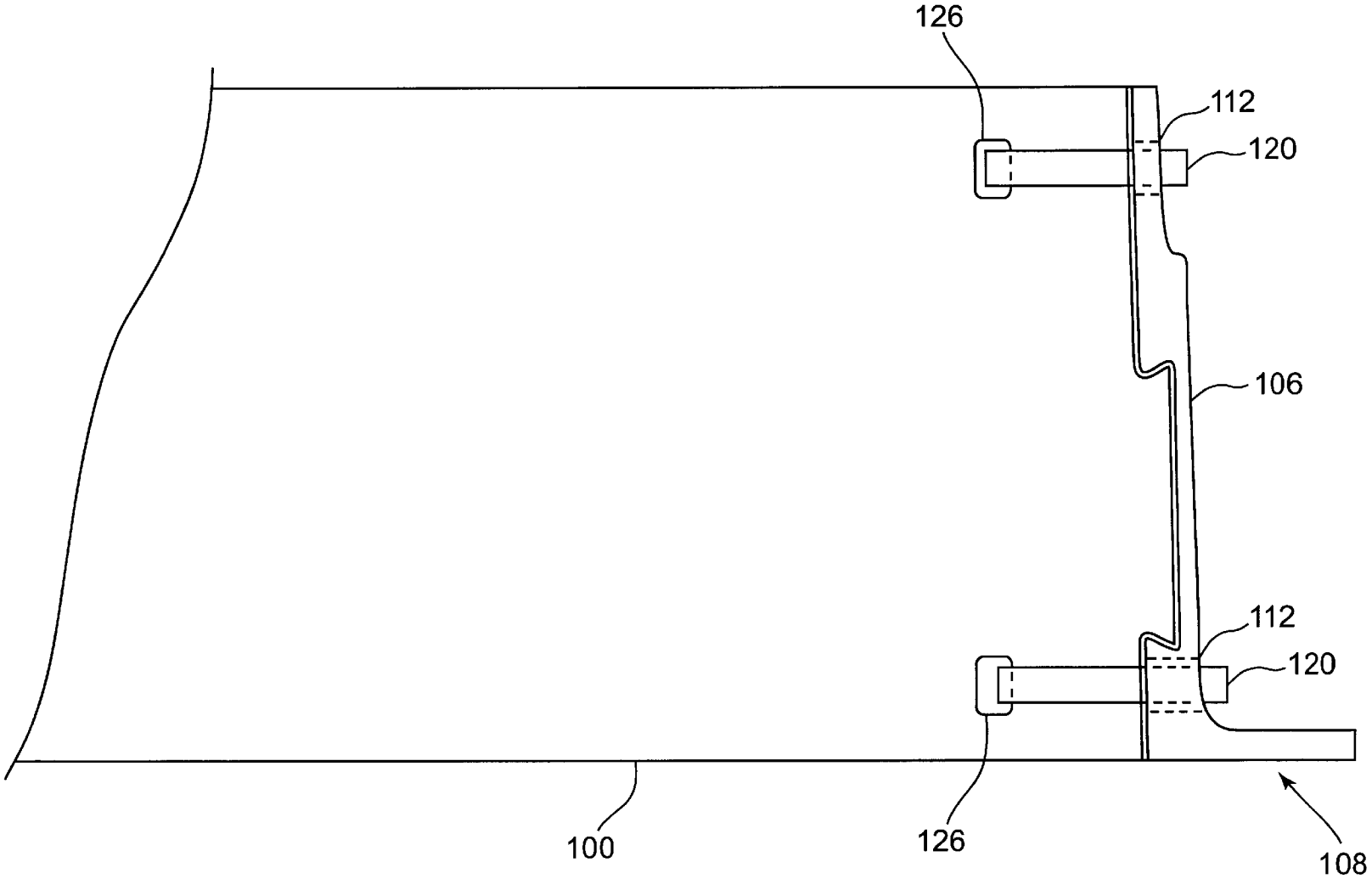
FIG. 8 is top view of a clip connection between according to the present invention where the shown clip connection is between with top frame and the side frame with the clip extending through holes in the side frame and the protrusions engaging holes on the top frame.

Depending on the need, the connections between frames 100, 102, 104, and 106 will vary. Where a rectangular embodiment of the modular frame 10 is employed, such as that shown in FIG. 1, the connection will occur directly between these frames at the corners. In this rectangular embodiment, the preferred embodiment for the corner connection uses a clip 120. One such clip connection is shown in FIG. 8. This clip connection is between top frame 100, which acts as a receiving frame, and side frame 106, which acts as a fastening frame. The side frame 106 has two holes 112, which allow the clips 120 to extend through the side frame 106. In addition, the top frame 100 has two holes 126 to receive the clips 120.

Figure 9:
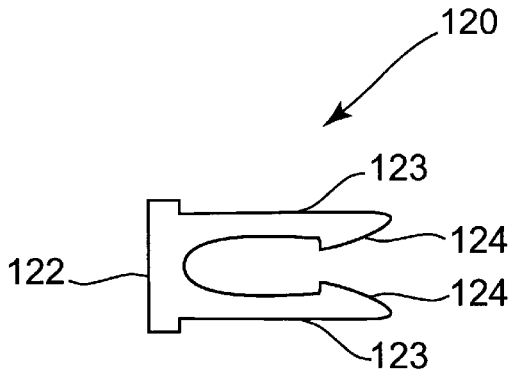
FIG. 9 is a front view of a clip showing the prongs according to the present invention.

As shown in FIG. 9, each clip 120 comprises a base 122, with prongs 123 extending outwardly from the base 122. Each protrusion 124 extends inwardly from the inner edge of the prong 123. The prongs 124 are biased inwardly, but are able to bend outward to allow the clip to be sandwiched around a receiving frame, which is top frame 100 in FIG. 9. At the end of each prong 123 is a protrusion 124. Due to the inward bias of the prongs 123, this protrusion 124 provides the gripping action required to connect the frame 100 to 106.

As shown in FIG. 8, the prongs 123 of each clip 120 are inserted through the corresponding hole 112. The prongs 123 are separated around top frame 100, with the protrusions 124 being received by the holes 126. Due to the inward bias, the prongs 123 continuously force the protrusions 124 into their respective holes 126, thus providing a positive connection between frames 100 and 106. This pattern is repeated using clips 120 to connect frames 100, 102, 104, and 106 for the rectangular embodiment of the modular louver system 1. It is understood that while the preferred embodiment does not use adhesives, these clips 120 can be also be used with adhesives. In addition, these holes 126 could be replaced by notches, grooves, or any other indentation so long as they provide a mechanism for the protrusions 124 to grip the receiving frame.

Figure 10:
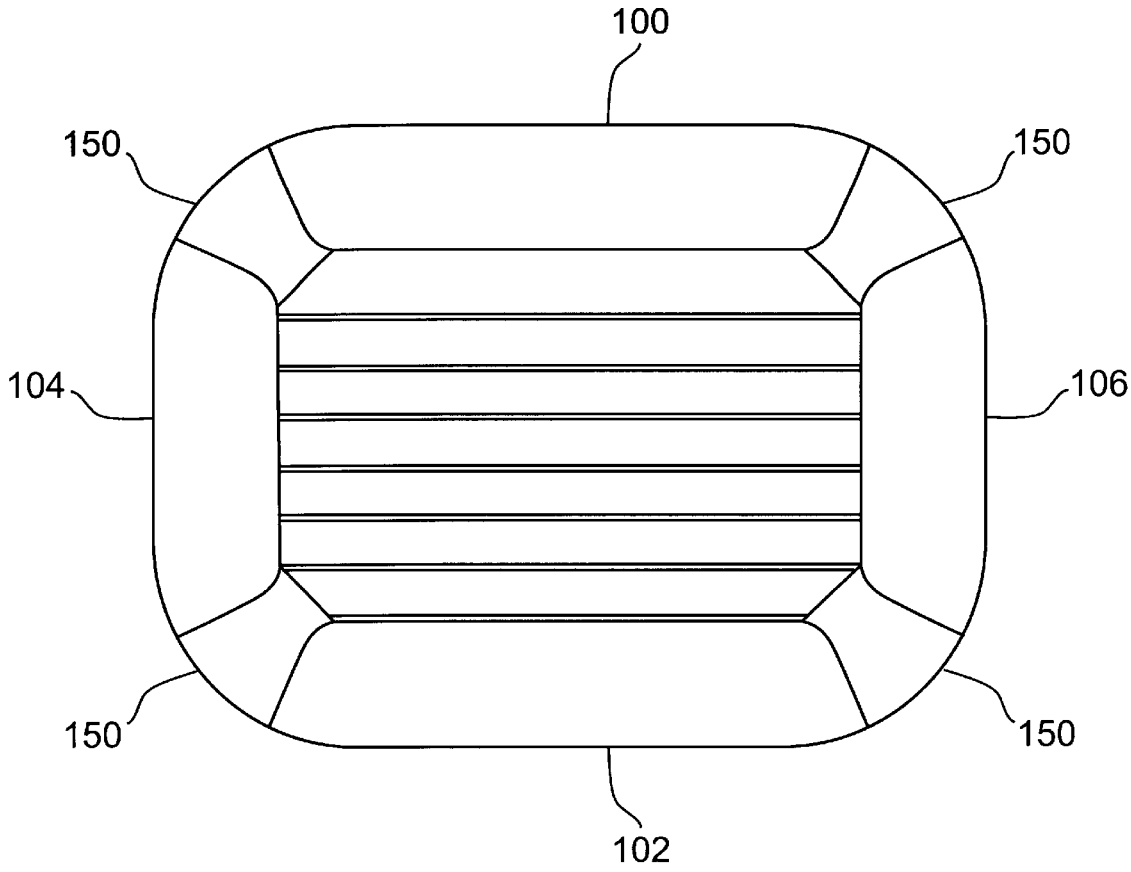
FIG. 10 is a front view of a rounded corner embodiment of modular louver system according to the present invention showing the corner frames connecting the top, bottom, and side frames.
Figure 11:
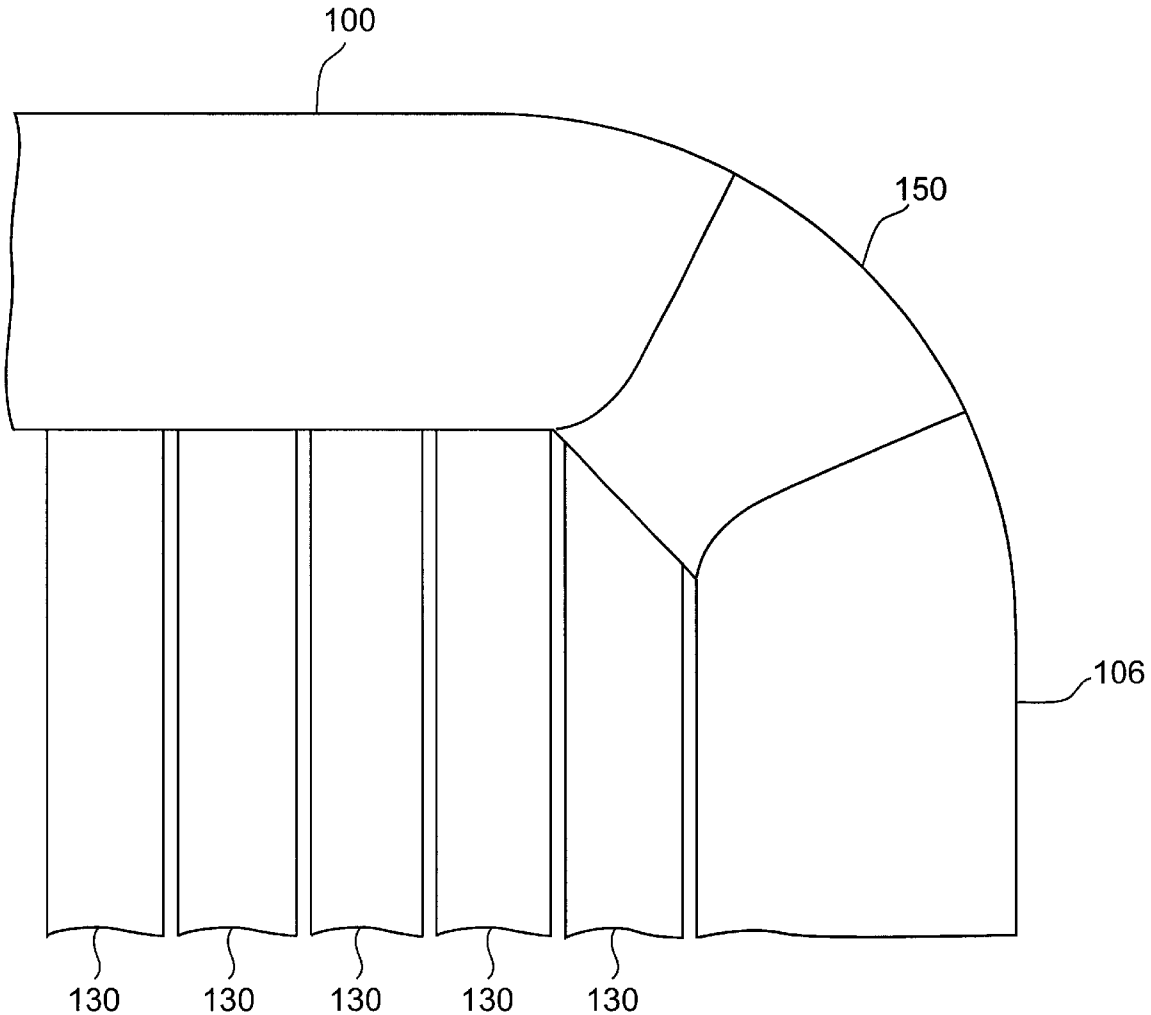
FIG. 11 is a top view of the connection between a corner frame and its adjacent top and side frames according to the present invention.

However, where other shapes are required, there is a need for joining elements that transition between straight elements in the modular frame 10. In a rounded corner embodiment, shown in FIG. 10, the modular frame 10 requires the use of corner frames 150. Each corner frame 150 has essentially the same cross section as a frames 100, 102, 104, and 106, meaning that it includes the fastening flange 108 and t-shaped channel 110 shown in FIG. 2. However, as shown in FIG. 11, the corner frame 150 is at an angle between the adjacent top frame 100 and side frame 104. In addition, the fastening flange 108 for corner frame 150 is rounded to the proper radius for the given application.

Figure 12A:
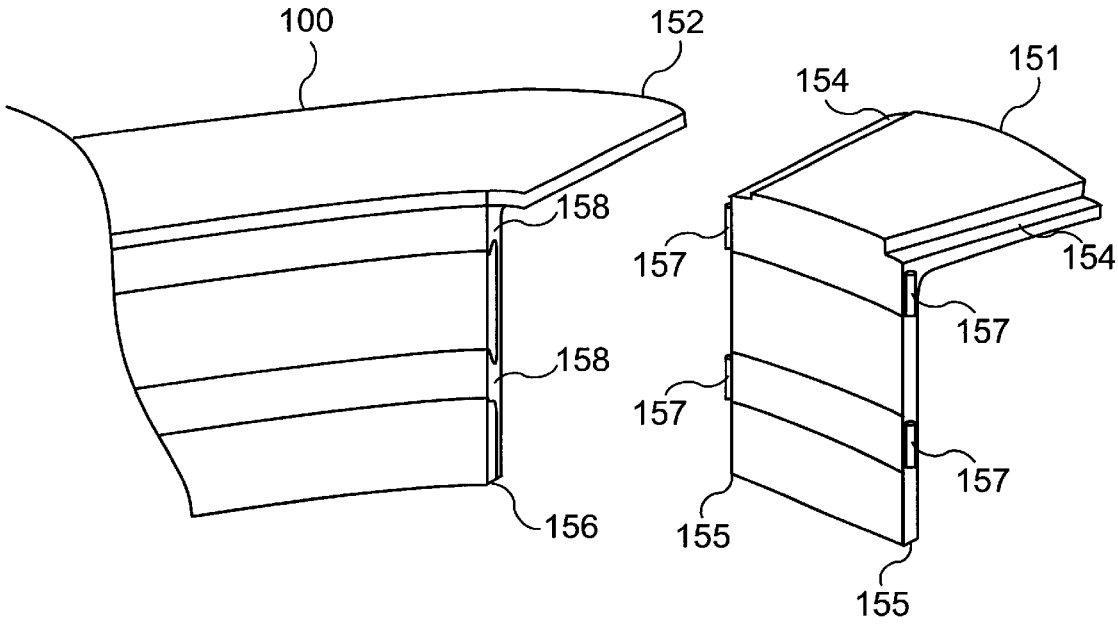
FIG. 12*a* is an exploded orthogonal view of the junction between the top frame and its adjacent corner frame showing the corner flange, the corner ledge, and the corner dovetail according to the present invention.
Figure 12B:
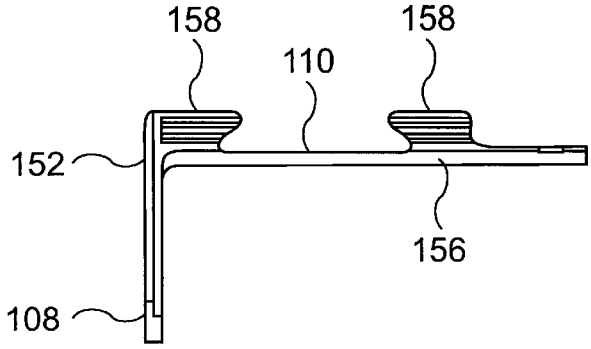
FIG. 12*b* is an end view looking into the frame edge of a top frame showing the corner t-shaped channels and corner ledges according to the present invention.

In the preferred embodiment, the corner frames 150 use corner dovetails 157 and corner ledges 154 as shown in FIG. 12*a*. As shown in FIG. 12*a*, a pair of corner dovetails 157 extend from corner edges 155, while the corner ledge 154 is on the top 151 of the corner frame 150. In addition, a frame flange 152 extends from the top frame 100. Lastly, as more clearly shown in FIG. 12*b*, the frame edge 156 includes a t-shaped groove 158 sized to receive the corner dovetails 157.

For the sake of simplicity, the connection between a corner frame 150 and its adjacent frames in FIG. 12*a* shows only one connection using the preferred embodiment: that between the corner frame 150 and top frame 100. The frame flange 152 overlaps the corner ledge 154, forming a lap joint. In addition, each corner dovetail 157 is in its respective the t-shaped groove 158 forming a dovetail connection. Through this lap joint and dovetail connection, the corner frame 150 can be attached to its adjacent frame without the use of adhesives, although adhesives and fasteners may be used as needed. This pattern of attachment is repeated through the modular frame 10 between corner frames 150 and their adjacent frames 100, 102, 104, and 106.

An advantage of the corner frame embodiment is, as shown in FIG. 11, louver vanes 130 can be inserted into the t-shaped channel 110 of the corner frames 150. This arrangement allows for a louver vane 130 to utilize the t-shaped channel 110 of the corner frame 150 so long as the dovetails 134 are angled to account for the alignment of the corner frame 150. In essence, this arrangement allows for the corner frames 150 to work as support elements similar to side frame 104 and 106.

Using combinations of frames 100, 102, 104, 106, and corner frames 150, one could fit the modular louver system 1 over most rounded openings, even those that are not oval in shape. In addition, it is recognized, but not shown, that the modular nature of the modular louver system 1 allows combinations of support and non-support elements that require more than two support elements and non support elements to create custom shaped modular frames 10, depending on the opening to be covered.

In the preferred embodiment, each frames 100, 102, 104, 106, corner frame 150, top spacer 142, bottom spacer 144, intermediate spacer 140, and louver vane 130 is made of glass fiber reinforced plastic composites, and are formed using a pultrusion process. This pultrusion process is found to be an economical means to create the modular louver system since it allows for the mass production of lightweight composite materials having a uniform cross section. However, it is recognized that many other non-composite materials will also work, and that there are many recognized means to create the parts that make up the modular louver system 1. In addition, it is recognized that not all of the elements of the modular louver system 1 need to be of the same material.

What has been described is only one of many possible variations on the same invention and is not intended in a limiting sense. The claimed invention can be practiced using other variations not specifically described above.

What is claimed is:

1. A modular louver system comprising:

a plurality of louver vanes having ends, wherein each said end comprises a dovetail;

a plurality of support elements wherein said support elements have a t-shaped channel; and wherein each said dovetail is in its corresponding said t-shaped channel.

2. The modular louver system of claim 1 further comprising a plurality of spacers wherein said spacers separate adjacent said louver vanes.

3. The modular louver system of claim 2 wherein said spacers comprise channel spacers, wherein said channel spacers are located in said t-shaped channels.

4. The modular louver system of claim 3 wherein said channel spacers are sized so as to define a consistent gap between said louver vanes.

5. The modular louver system of claim 4 further comprising a plurality of non-support elements, wherein said non-support elements separate and connect said support elements defining a modular frame.

6. The modular louver system of claim 5 further comprising terminal spacers, wherein said terminal spacers are in at least one said t-shaped channel between said dovetail of said louver vanes and said non-support elements.

7. The modular louver system of claim 6 wherein said channel spacers and said terminal spacers are sufficiently large to dampen the movement of said dovetails in said t-shaped channels.

8. The modular louver system of claim 7 wherein said support and non-support elements of said modular frame have equivalent cross-sections.

9. The modular louver system of claim 8 wherein said support and non support elements are joined using a plurality of clip connections joining a receiving frame to a fastening frame, wherein each said clip connection comprises a plurality of clips having prongs, wherein said prongs are inwardly biased and further include inwardly facing protrusions, wherein each said fastening frame further includes holes, wherein said receiving frame further includes holes, wherein said prongs extend through said holes in said fastening frame to said holes in said receiving frame, and wherein said protrusions engage said holes in said receiving frame.

10. The modular louver system of claim 9 wherein said support elements comprise a first support element and a second support element, wherein said first support element, said second support element, said non-support elements, said spacers, and said louver vanes are made of a composite material.

11. A modular louver system comprising:

a plurality of support elements having t-shaped channels;

a plurality of non-support elements;

a plurality of joining elements;

a plurality of louver vanes having ends wherein each said end comprises a dovetail;

wherein said joining elements connect said non-support elements to their adjacent said support elements to form a modular frame; and wherein said dovetails are inserted in said t-shaped channels.

12. The modular louver system of claim 11 further including a plurality of spacers separating adjacent louver vanes.

13. The modular louver system of claim 12 wherein said spacers comprise channel spacers wherein said channel spacers are located in said t-shaped channels.

14. The modular louver system of claim 13 wherein said channel spacers are sized so as to define a consistent gap between said louver vanes.

15. The modular louver system of claim 14 further comprising terminal spacers, wherein said terminal spacers are in said t-shaped channel separating said joining elements from adjacent said louver vanes.

16. The modular louver system of claim 15 wherein said channel spacers and said terminal spacers are sufficiently large to dampen the movement of said dovetails of said louver vanes in said t-shaped channels.

17. The modular louver system of claim 16 wherein at least one of said joining elements further includes a t-shaped channel, wherein at least one said dovetail and at least one said channel spacer is in said t-shaped channel of said joining elements.

18. The modular louver system of claim 17 wherein each said joining element further comprises a corner dovetail and a corner ledge, wherein each said support element further comprises t-shaped grooves and frame flanges, wherein each said corner dovetail is in its respective said t-shaped groove, and each said corner flange forms a lap joint with its respective corner ledge.

19. The modular louver system of claim 18 wherein said support elements, said non-support elements, and said joining elements have essentially the same cross section.

* * * * *